US006000989A

United States Patent [19]

Bacque

[11] Patent Number: 6,000,989

[45] **Date of Patent: *Dec. 14, 1999**

[54] LASSO TOY

[75] Inventor: Steve E. Bacque, Linden, N.J.

[73] Assignee: Strombecker Corporation, Chicago, Ill.

[ * ] Notice: Under 35 U.S.C. 154(b), the term of this patent shall be extended for 203 days.

[21] Appl. No.: 08/549,061

[22] Filed: Oct. 27, 1995

[51] Int. Cl.[6] ..... A63H 1/00; A63H 33/00

[52] U.S. Cl. ..... 446/236; 446/490

[58] Field of Search ..... 446/236, 486, 446/490, 901, 247; 482/82, 81

[56] References Cited

U.S. PATENT DOCUMENTS

| | | | |
|---|---|---|---|
| 2,044,240 | 6/1936 | Daniels | 446/247 |
| 2,223,174 | 11/1940 | Hughes | 482/82 |
| 2,563,533 | 8/1951 | Knox | 446/486 X |
| 2,592,696 | 4/1952 | Hoody | 482/81 X |
| 2,968,117 | 1/1961 | Trombly | 446/247 X |
| 3,041,932 | 9/1962 | Schweitzer | 482/82 |
| 3,249,356 | 5/1966 | Schweitzer | 482/82 |
| 3,423,095 | 1/1969 | Cox | 446/901 X |
| 3,450,405 | 6/1969 | Mates | 446/901 X |
| 4,375,886 | 3/1983 | Muys | 482/82 |
| 5,005,828 | 4/1991 | Sauerbrey | 446/901 X |

FOREIGN PATENT DOCUMENTS

| | | | |
|---|---|---|---|
| 586051 | 3/1977 | Switzerland | 446/236 |

*Primary Examiner*—D Neal Muir
*Attorney, Agent, or Firm*—Jones, Day, Reavis & Pogue

[57] ABSTRACT

A lasso toy comprises a generally elongate rope and a handle having an axial bore dimensioned to slidingly receive the rope. A swivel is provided on a first end of the rope and cooperates with the handle to permit rotational movement of the handle about the rope while limiting axial movement of the rope relative to the handle. The second end of the rope is detachably secured preferably by hook and loop fasteners to an intermediate portion of the rope and thereby create a noose. The fasteners permit the noose to release under moderate tension of the rope if the lasso is used unsafely.

11 Claims, 1 Drawing Sheet

LASSO TOY

BACKGROUND OF THE INVENTION

1. Field of the Invention

The present invention relates generally to a lasso toy and, more particularly, to a lasso toy which is designed to be safely and easily used by children of all ages.

2. Description of the Prior Art

The lasso has proved to be a valuable tool particularly as used by horsemen to catch horses or cattle. It generally comprises a long rope tied at one end in a noose. Typically, the noose is tied with a slip knot such that the noose can readily be expanded or contracted. When used to catch animals the noose is usually twirled in the air in an expanded condition and thrown over the head of the animal. Upon tensioning of the rope, the noose tightens about the neck of the animal and the animal can be safely restrained.

Not only is the lasso a valuable tool, but persons who are skilled in its use are often able to perform various tricks with a lasso. As a result, trick lasso performances can be seen at rodeos and other western shows to the delight of both the young and old. Children of all ages find using the lasso to be an entertaining pastime. However, lasso tricks typically require considerable manual dexterity which young children may not have. Further, the lasso noose requires some skill to tie and must be properly proportioned in its circumference to achieve the desired loop configuration when twirled in the air.

It is, therefore, desirable to provide a lasso toy which is easily formed with a noose. It is further desirable to provide such a toy which can be easily manipulated by young children to simulate the twirling loop configuration of a real lasso. Still further, it is desirable to provide a lasso toy which is safe for young children to use because it avoids the possibility that the noose can be tightened to the point of being capable of causing bodily injury.

SUMMARY OF THE INVENTION

The present invention provides a toy lasso which can easily be used by young children to simulate the action of a real lasso by using a handle to which a length of rope is swivelably attached. The free end of the rope is looped around and attached to an intermediate portion of the rope by hook and loop fastening material to form a noose. The handle may thereby be grasped and the noose may be twirled in the air without requiring skilled wrist movement. Because the hook and loop material detaches under moderate tensioning of the rope the noose will open without presenting a danger of becoming tightly wrapped around objects or people.

BRIEF DESCRIPTION OF THE DRAWING

The foregoing and other features and advantages of the invention will be better understood upon a reading of the following detailed description taken in conjunction with the accompanying drawing wherein.

DETAILED DESCRIPTION OF THE PREFERRED EMBODIMENT

Figure 1:
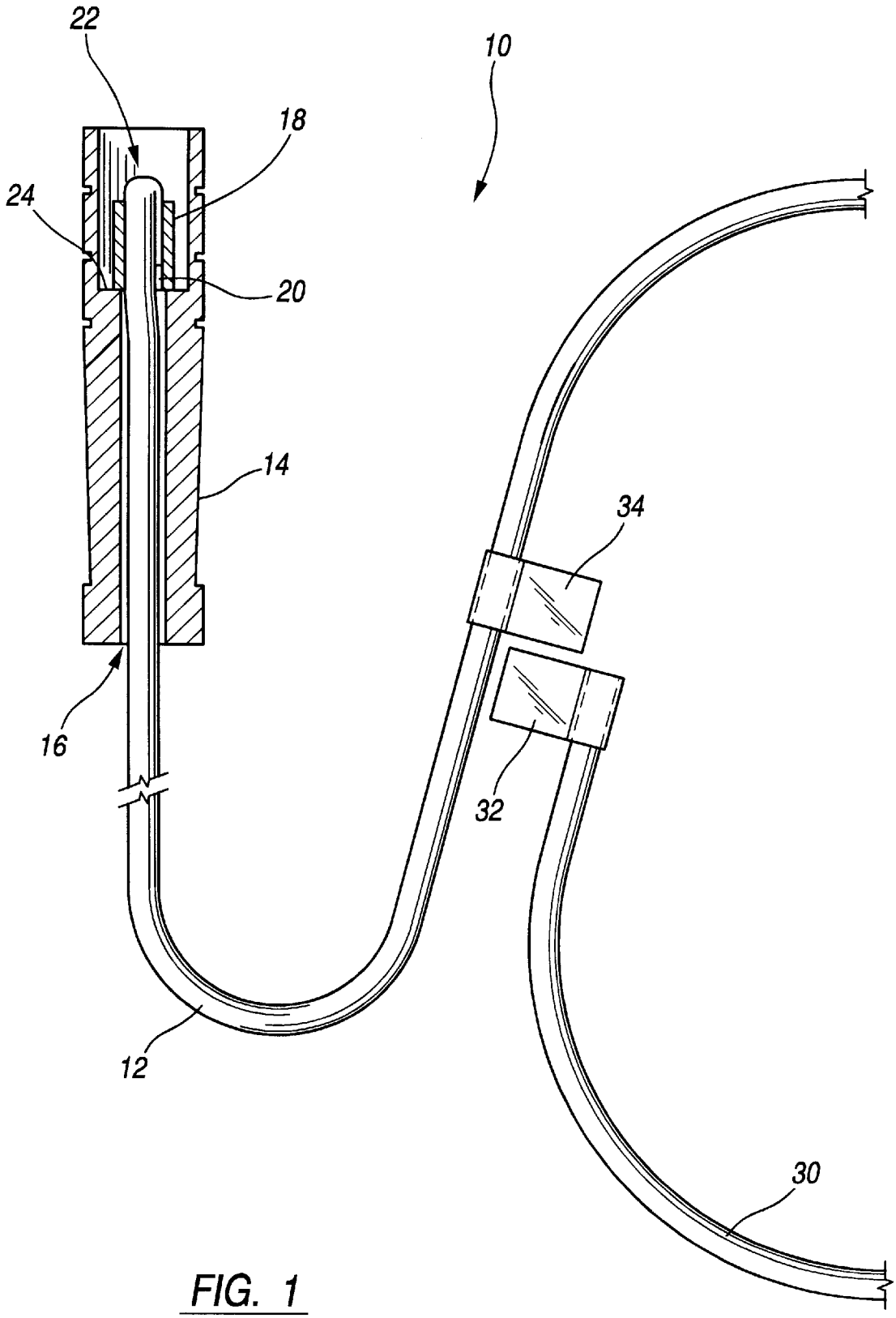
FIG. 1 is a partial cross-sectional view of a lasso toy constructed in accordance with the principles of the invention, the rope being shown in fractional form.

Referring now to the drawing, FIG. 1 illustrates a lasso toy constructed in accordance with the principles of the invention and designated generally by the reference numeral 10. The lasso 10 comprises as a principle component and generally elongate length of rope 12. A particularly suitable and readily available type of rope for the lasso 10 is a solid braid of 100% cotton exterior and a polyester core. Rope of this type is generally used for sash cord, for example. The rope 12 is attached at a first end to a handle 14, which may be plastic or wood. The handle 14 has a through bore 16 extending axially thereof, the bore 16 being suitably sized to sliding receive the rope 12. A generally cylindrical swivel member 18, which may be plastic or metal, has a recess 20 in it which the end of the rope is doubled over on itself and pressed into. The swivel 18 is thus securely fastened to the end of the rope 12. The handle 14 preferably has a large recess 22 formed in its upper end, as viewed in FIG. 1, defining a bearing surface 24 for abutment with the swivel 18. By the foregoing construction, the rope 12 can readily rotate within the handle 14 but is restrained from downward, axial movement through the handle 14 by the swivel 18. The recess 22 serves to enclose the swivel 18 such that it is protected against obstruction. Thus, the rope 12 is free to rotate while the handle 14 is grasped firmly.

As will be described in detail hereinafter, the rope 12 is sufficiently long as to be looped into a noose 30. In accordance with the invention the free end of the rope 12 has a tab of loop VELCRO fabric 32 attached to it. At a point intermediate the ends of the rope 12 a tab of hook VELCRO fabric 34 is attached to the rope 12. The hook 32 and loop 34 material thereby provide for securing the free end of the rope 12 to an intermediate portion of the rope 12 to define the noose 30. In a preferred form, the hook and loop tabs 32 and 34, respectively, comprise strips of material each ⅝ inch wide and 2 inches long wrapped around the rope 12 and secured to the rope 12 by sewing.

It can now be appreciated that a lasso toy 10 in accordance with the invention provides a highly effective and safe means for entertaining children both young and old. The child may simulate the twirling noose of a real lasso by simply grasping the handle 14 and rotating the wrist whereupon the noose 30 will begin rotating and assume an expanded circular configuration. Should the noose 30 become wrapped around an object or a person the VELCRO tabs 32 and 34 will separate under a modest tension. In the embodiment described using tabs of ⅝-inch width and two-inch length material, approximately ten pounds of tension in the rope 12 will separate the tabs 32 and 34. Thus, the noose 30 of the lasso 10, unlike the noose of a real lasso, cannot be pulled tight around objects.

An important feature of the lasso 10 is that the noose 30 is dimensioned as to have a circumference approximately equal to four-fifths the total length of the rope 12. In a preferred form of the invention a noose 30 circumference of sixty inches to a total rope 12 length of seventy-five inches has proved to be most advantageous. By this arrangement, the noose 30 is properly balanced and can be easily twirled by even the youngest user.

While the present invention has been described in connection with a preferred embodiment thereof, it will be understood by those skilled in the art that many changes and modifications may be made without departing from the true spirit and scope of the invention. Accordingly, it is intended by the appended claims to cover all such changes and modifications as come within the true spirit and scope of the invention.

What is claimed is:

1. A lasso toy comprising:

a generally elongate rope;

a handle having an axial bore, said bore being dimensioned to slidingly receive said rope;

a swivel provided on a first end of said rope, said swivel cooperating with said handle to permit rotational movement of said handle about said rope while limiting axial movement of said rope relative to said handle; and means cooperating between a second end of said rope and an intermediate portion of said rope for detachably securing said second end to said intermediate portion of said rope and thereby create a noose, said securing means permitting said second end to release from said intermediate portion under limited predetermined tension in said noose to thereby prevent unsafe use of said toy.

2. The toy of claim 1 wherein said handle is provided with a recess defining an internal surface and said swivel abuts said surface in sliding engagement.

3. The toy of claim 1 wherein said swivel is a generally cylindrical member and said first end of said rope is fixedly secured thereto.

4. The toy of claim 3 wherein said first end of said rope is doubled over on itself and forced into a recess of said swivel.

5. The toy of claim 3 wherein said handle is provided with a recess defining an internal bearing surface on which said swivel rotates.

6. The toy of claim 1 wherein said means for securing said second end of said rope to said intermediate portion is hook and loop fastening material.

7. The toy of claim 1 wherein said noose has a circumference approximate equal to four-fifths the total length of the rope.

8. The toy of claim 1 wherein said noose has a circumference of approximately sixty inches and said rope has a total length of approximately seventy-five inches.

9. The toy of claim 6 wherein said hook and loop fastening material is sewn to said rope.

10. A lasso toy comprising:

a generally elongate rope;

a handle having an axial bore said bore being dimensioned to slidingly receive said rope;

a swivel attached to a first end of said rope, said swivel cooperating with a surface of said handle to permit rotational movement of said rope within said handle while limiting axial movement of said rope relative to said handle; and hook and loop fastening material cooperable between a second end of said rope and an intermediate portion of said rope to form said rope into a noose, said material being dimensioned and configured to permit release of said second end from said intermediate portion upon predetermined limited tension of said noose to thereby prevent unsafe use of said toy.

11. The toy of claim 10 wherein said noose has a circumference approximately equal to four-fifths the length of the rope.

* * * * *